United States Patent [19]

Krutenat

[11] Patent Number: 4,500,364

[45] Date of Patent: Feb. 19, 1985

[54] METHOD OF FORMING A PROTECTIVE ALUMINUM-SILICON COATING COMPOSITION FOR METAL SUBSTRATES

[75] Inventor: Richard C. Krutenat, New Providence, N.J.

[73] Assignee: Exxon Research & Engineering Co., Florham Park, N.J.

[21] Appl. No.: 371,257

[22] Filed: Apr. 23, 1982

[51] Int. Cl.[3] ..... C23C 1/08

[52] U.S. Cl. ..... 148/6.14 R; 148/31.5

[58] Field of Search ..... 427/376.3, 376.5, 383.9; 148/6.14 R, 31.5

[56] References Cited

U.S. PATENT DOCUMENTS

| | | | |
|---|---|---|---|
| 3,102,044 | 8/1963 | Joseph | 427/190 |
| 3,536,776 | 10/1970 | Lo | 260/683 |
| 3,620,693 | 11/1971 | Sauso et al. | 29/195 |
| 3,704,333 | 11/1972 | Spangler et al. | 260/683 R |
| 3,827,967 | 8/1974 | Nap et al. | 208/48 R |
| 3,989,863 | 11/1976 | Jackson et al. | 427/367 |
| 4,039,318 | 8/1977 | Patel | 75/0.5 R |
| 4,190,443 | 2/1980 | Patel | 75/252 |

FOREIGN PATENT DOCUMENTS

| | | | |
|---|---|---|---|
| 1449260 | 9/1976 | United Kingdom . | |
| 1529441 | 10/1978 | United Kingdom . | |
| 621797 | 8/1978 | U.S.S.R. | 427/383.9 |

OTHER PUBLICATIONS

E. Fitzer et al., "Aluminum and Silicon Base Coatings for High-Temperature Alloys . . . ", *Thin Solid Films*, vol. 64, 1979, pp. 305-319.

S. G. Young et al., "An Experimental Low-Cost Silicon Slurry/Aluminide High-Temperature Coating for Superalloys", NASA Technical Memorandum 79178, Jul. 1979, pp. 1-10.

Drewett, R., *Diffusion Coatings for the Protection of Iron and Steel*, Anti-Corrosion, Apr. 1969, pp. 11-16.

Chem. Abs., vol. 84, No. 10, Mar. 8, 1976, p. 296, abs. No. 63866S, J. L. Smialek, "Fused Silicon-Rich Coatings for Superalloys."

Chem. Abs., vol. 88, No. 24, Jun. 1978, p. 313, abs. No. 175274m, V. N. Mukhin et al., "Use of Aluminum-Silicon Suspensions for the Formation of Heat-Resistant Coatings on E1-826 and EP-539 Alloys".

*Primary Examiner*—Evan K. Lawrence

*Attorney, Agent, or Firm*—Eugene Zagarella

[57] ABSTRACT

A method of coating metal substrates with a protective aluminum-silicon coating comprising a mixture of (1) an Al-Si eutectic, Al-Si hypereutectic or elemental aluminum and (2) elemental silicon, the articles of manufacture provided by said coating and the method of carrying out thermal hydrocarbon processing operations where corrosion/erosion and other high temperature interactions are a problem using apparatus containing said coatings.

4 Claims, No Drawings

METHOD OF FORMING A PROTECTIVE ALUMINUM-SILICON COATING COMPOSITION FOR METAL SUBSTRATES

BACKGROUND OF THE INVENTION

This invention relates to a method of forming an aluminum-silicon coating composition for protecting ferrous metal substrates from corrosion/erosion, metal dusting, carburization, and other types of high temperature and oxidation interactions which occur during hydrocarbon processing operations.

Various hydrocarbon processing operations including the thermal decomposition of organic compounds, such as the cracking or disproportionation of hydrocarbons, coal gasification etc. have been carried out using steel alloy equipment. While such metal alloys have been particularly useful in increasing the performance life of the respective equipment, problems such as carburization, corrosion and coke deposition are still of concern. One such problem that arises is carburization of the metal which involves diffusion of carbon into the metal which results in embrittlement and can lead to metal loss and eventual failure of the equipment.

A variety of coatings and techniques have been tried to overcome the different problems of the aforesaid types.

Metallic overlay coatings including aluminum and small percentages of silicon have been placed on ferrous metal surfaces to prevent carburization, see British Pat. No. 1,449,260 and U.S. Pat. No. 3,827,967. Metal-ceramic coatings have also been employed, viz., aluminum oxide dispersed in chromium as described in U.S. Pat. No. 3,536,776 but adherence of the preformed oxide to the metal substrate is notably inferior as compared with growing the oxide in situ.

McGill and Weinbaum in Metal Progress, 26, February 1979, have proposed diffusing aluminum vapor into pyrolysis tubes, however, in this method diffusion of aluminum can continue with loss of aluminum into the interior of the tube wall.

Silicon oxide films may be developed on steel surfaces by pretreatment of the bulk alloy containing silicon with steam at elevated temperatures and are said to provide protection against carburization as disclosed in U.S. Pat. No. 3,704,333. Since silicon is a ferrite stabilizer, the amount that can be incorporated in austenitic stainless steels—which generally are used for hydrocarbon pyrolysis operations—is low, of the order of 1 to 2%. In U.S. Pat. No. 4,248,629 the bulk alloy contains silicon and aluminum, both in small amounts.

Duplex or two-layer coatings which require application of two different compositions in sequence has also been disclosed, for example in Arcolin et al., Plasma Spray Conference, The Hague, May 1980, p. 84. In general, they are less practical because of factors of time, more complex operations, unsuitability for application onsite, and the like. See also British Pat. No. 1,529,441 in which three distinct steps may be employed.

Other metal or ceramic coatings have been disclosed to prevent carburization or for other non-specific purposes, see U.S. Pat. No. 3,620,693 and Miller et al., Metal Progress, 103, 80, No. 3 (1973). Vitreous coatings on metals are known as disclosed in U.S. Pat. No. 2,976,171 and No. 4,149,910.

Tien and Pettit, Metallurgical Transactions, 3, 1587 (1972) have shown that yttrium improves the adherence of an $Al_2O_3$ scale which develops during oxidation of a Fe-25Cr-4Al alloy.

U.S. Pat. No. 4,190,443 discloses the flame spraying of eutectics, e.g. $TiSi_2$ plus Si, mixed with another metal power such as Ni, with a final percentage of silicon of 8%. This is said to be an improvement of U.S. Pat. No. 4,039,318 which discloses $TiSi_2$ with Al and Ni powders. Flame spraying of metal powders requiring the use of a torch is inapplicable to tubes of narrow internal diameter and long length, used in hydrocarbon pyrolysis. Furthermore, such coatings are too porous to be effective at high temperatures involving gaseous species.

The use of fugitive binders to form Al-Si coatings containing up to 10% silicon, is taught in U.S. Pat. No. 3,102,044.

Some of the coatings that have been proposed contain low amounts of silicon. At the other end of the spectrum, coatings of very high silicon content have been produced but only on special metal substrates. Thus, Packer and Perkins in JI, Less Common Metals, 37, 361 (1974), discussed the development of fused slurry silicide coatings for tantalum alloys for use at 1427°–1538° C. Coatings having Si contents in the range of 53–64% were found most effective on tantalum. One problem mentioned by the authors is the volatilization of SiO under conditions of low oxygen partial pressures. This is a condition known to be present in steam cracking, particularly at high temperatures and low steam dilution.

Similarly, Priceman and Sama reported in Electrochemical Technology, 6, 315, No. 9–10, September, October (1968) the use of elemental powders in an organic binder sprayed on a columbium part, then fired, a preferred composition being 60Si-20Cr-20Fe which forms silicides of columbium, chromium and iron. Young and Deadmore describe in Thin Solid Films, 73, 373 (1980) an Al-Si coating formed by spraying an elemental silicon powder slurry on nickel-base superalloy specimens followed by a pack aluminizing treatment at 1100° C. for 16 hours in argon, which is basically aluminizing, viz., a diffusion process. This is a duplex coating process with the inconvenience which that entails. Elbar b.v. Industrieterrain "Spikweien" have described their product, Elcoat 360, as a high silicon content (20 to 25%) coating on In 738, a nickel base alloy, forming a final dispersion of stable silicide phases and suitable for turbine applications.

On the other hand, Fitzer et al., in "Materials and Coatings to Resist High Temperature Corrosion" Edited by D. R. Holmes and A. Rahmel, Applied Science Publishers, Ltd., London, 313 (1980) reported the difficulty of protecting ferrous metals against high temperature oxidation by means of silicon-containing coatings because of high reactivity of silicon towards iron. As a consequence of this, asymmetric interdiffusion of both elements occurs, leading to immediate impairment of the coatings (the Kirkendall effect). In work with nickel base alloys they found it expedient to aluminize prior to slurry coating with $CrSi_2/NiSi_2$, thus a duplex coating process. However, the properties of the product were not satisfactory. Further work reported in Thin Solid Films, 64, 305 (1979) on iron base alloys led to duplex coatings with lower Si content, viz., aluminized AISI310 with NiCr15TaSi10 interlayer.

Other literature on coatings includes:

U.S. Pat. No. 3,989,863

Daimer et al., Abstract Booklet International Conference on Metallic Coatings, San Francisco, CA, Apr. 6–10, 1981
Wohl et al., ibid
Vargas et al., Thin Solid Films 73, 407 (1980)
Brochure 101, 1977, Sermetel Corp., Limerick, PA.

While the above described coatings and techniques do provide some protection from metal substrates involved in high temperature process applications, there still is the need to obtain a coating composition for ferrous substrates which is of fairly simple constitution and can be applied in a relatively easy manner so as to be applicable to a variety of articles and different process applications.

SUMMARY OF THE INVENTION

Now in accordance with this invention, a method is provided for coating a metal substrate with a coating formed from a mixture of (1) an Al-Si eutectic, Al-Si hypereutectic or elemental aluminum and (2) elemental silicon. The method provides a protective coating using a relatively simple application technique which makes it useful for a variety of articles and apparatus.

More particularly, this invention is directed to a method of coating a ferrous metal substrate by applying thereto a composition in the form of a slurry in a liquid vehicle which comprises a mixture of (1) an Al-Si eutectic, Al-Si hypereutectic or elemental aluminum powder and (2) elemental silicon powder, heating the coating composition to a temperature high enough to form eutectic liquid but low enough to retain elemental silicon in solid form and then cooling to form the final coating which contains aluminides and silicides formed from the interaction with the metal substrate, said composition mixture components being present in sufficient amounts to provide the final coating with a net silicon content of about 20 to about 80% by weight.

The process of the invention results in an article of manufacture comprising a coated metal substrate in which the coating is formed from a mixture of (1) an Al-Si eutectic, Al-Si hypereutectic or elemental aluminum and (2) elemental silicon, said components being present in amounts sufficient to provide the final coating after firing with a net silicon content of about 20 to about 80% by weight.

DETAILED DESCRIPTION OF THE INVENTION

One problem that arises in the slurry painting of steel with a source of silicon involves the aggressiveness of a liquid alloy containing silicon when in contact with the steel at high temperature. The coated article and method of coating of this invention overcomes this problem by providing a duplex-phase microstructure wherein the presence of aluminum controls the aggressive reaction of silicon and steel.

According to this invention, a special hypereutectic aluminum-silicon composition made from (1) elemental silicon powder and (2) an Al-Si eutectic or hypereutectic powder or elemental aluminum is particularly useful as a coating composition. The coating is applied in a prescribed manner such that interaction occurs with the iron or alloy steel substrate so as to form aluminides and silicides and produce a smooth, uniform, duplex-phase microstructure having a gradually increasing hardness through the depth of the coating.

The protective coating composition of this invention is provided by employing a sufficient amount of the Al-12Si eutectic or Al-Si hypereutectic to take advantage of the relatively low melting point of the eutectic (577° C.) which allows liquid to form while keeping the elemental silicon in solid metallic form. The control of the amount of liquid present during fusion is necessary for the control of coating uniformity and the production of a duplex microstructure having the desired mechanical properties.

Generally, a coating composition having the desired properties can be formed when using a mixture of (1) the Al-Si eutectic, Al-Si hypereutectic or elemental aluminum and (2) elemental silicon in suitable amounts to provide a final coating composition having a net silicon content of about 20 to about 80% by weight, preferably about 40 to abut 60% by weight and more preferably about 50% by weight. When using the Al-12Si eutectic, the desired coating composition having the aforesaid net silicon content can be provided by using a mixture of about 9 to about 77% by weight silicon and about 91 to about 23% by weight of the Al-12Si eutectic, preferbly about 32 to about 55% by weight silicon and about 68 to about 45% by weight of the Al-12Si eutectic and more preferably about 43% by weight silicon and about 57% by weight Al-12Si eutectic. The term Al-Si "hypereutectic" as used throughout this application refers to an Al-Si composition having more than about 12% by weight of silicon content. It is also contemplated that the desired final coating composition of this invention can be provided by adding the elemental powders of aluminum and silicon in amounts sufficient to provide the aforesaid net silicon content or by rapidly solidifying a melt of appropriate composition (atomic mixture) to achieve the metastable phase of solid solution.

The preferred coating composition is prepared using the Al-12Si eutectic or Al-Si hypereutectic and more preferably the Al-12Si eutectic.

The coating is typically prepared by mixing the Al-12Si eutectic powder made by gas atomization, or Al-Si hypereutectic or elemental aluminum with elemental silicon powder in a liquid vehicle. Preferably, the liquid vehicle is a fugitive organic vehicle but an aqueous inorganic compound vehicle may also be used. The vehicle may comprise a binder material, usually a resin, in an organic solvent. The coating in this form of liquid vehicle, may be applied as a slurry by painting e.g. brushing, dipping and draining, or spraying the material into the desired substrate.

The coating of this invention is advantageously applied to ferrous metals or alloys, viz, iron metals or iron-base alloys, including all types of steels such as carbon steel and particularly iron based heat-resistant alloys, such as HP, HK-40, Manaurite 36XS or Manaurite 900B, Duraloy HOM, Incoloy Alloy 800, Incoloy Alloy 800H, and the like, but also may be used on other substrates if desirable, such as 304, 310, 316 and 347 and other austenitic stainless steels as well as nickel base or cobalt base alloys (the superalloys), particularly when it would otherwise be necessary to use time-consuming procedures or special atmospheres or to put on a duplex coating.

The coated products may be used in the heat treatment of carbon-containing gases or hydrocarbon liquids with their associated solvents and in thermal hydrocarbon conversion processes employing carburizing atmospheres, such as thermal cracking including steam cracking and cracking without the addition of steam, steam reforming, or in coal gasification but may also be used in high or low pressure hydrocracking, visbreaking, hydrodesulfurizing and the like. The coating of this invention is particularly useful in providing corrosion resistance to a number of different articles or apparatus such as tubes, valves, impellers, blading and reactors used in various aspects of refining and synfuels manufacture. The ability of the coating to arrest coke deposition and stop metal dusting can be particularly useful in making catalytic coal gasification schemes viable in practice. The inherent hardness of the coating resulting from the reaction produced hard silicide particles can be anticipated to be useful in resisting erosion in particulate loaded hydrocarbon streams such as occur in the processing of coal derived fuels as well as for high velocity two phase flow situations where erosion-corrosion occurs, e.g. NMP (N-methyl pyrrolidone) extract furnaces. Other processes where the coating of this invention may be of particular advantage are those involving acid streams and $H_2S$.

The coating of this invention may be applied as a slurry of the powders in a vehicle suitably consisting of a binder such as ethylmethacrylate (5 to 25%) and a solvent such as trichloroethane (75 to 95%) by a painting or dipping technique. Methyl, butyl, lactyl and higher analogs of the ethylmethacrylate are also suitable. An alternative medium is a lacquer of nitrocellulose in a solvent such as butyl acetate. A further alternative binder may be polystyrene dissolved in trichloroethylene or polyvinyl acetate in methanol, or other thermally polymerized resins. The coating is subsequently fired at a suitable temperature of e.g. about 1290° F. (700° C.) to about 1850° F. (1045° C.) and preferably about 1650° to about 1850° F. in a controlled atmosphere such as a vacuum, pure hydrogen or in a pack protected paint (described below) to avoid oxidation of the metal powders. A vacuum pressure of the order of 0.1 to 0.001 micron or high purity hydrogen with a dew point of −95° F. or lower can be used. The coating is generally fired in vacuum at times for example of between about 5 minutes to 3 hours or alternatively heat treated in high purity hydrogen at the same temperature for the same time during which the vehicle volatilizes and the coating is bonded to the metal substrate. Other ueful inorganic vehicles include aqueous solutions of sodium silicate or calcium silicate or aluminum phosphate, for example a mixture of 90% water and 10% calcium silicate.

The amounts of eutectic powder and elemental silicon powder or other components which are used to prepare the coating of this invention are described above, it being understood that the coatings may include minor amounts of other constituents or mixtures thereof, e.g. up to about 2%, added to confer specific benefits, such as boron (permits bonding heat treatment at lower temperature), calcium, barium, and strontium (promotes coke gasification) lanthanum and zirconium (improve adherency of Al oxide scale), which do not detract from the desirable characteristics described above. Generally about 300 to 400 micron thickness of painted coating is acceptable to produce a finished, fused coating of about 200 to 300 microns (10–15 mil).

A problem that may arise in the slurry application method is porosity in the form of blisters due to uneven release of the decomposition products of the vehicle during vacuum heat treatment. An improved method has now been found which eliminates blistering and also allows the coating to be processed without high vacuum or high purity hydrogen.

In connection with coating the internal surface of a metal walled container or reactor in the form of a tube, this improved method involves the use of a temporary sand pack on the inside of the tube after the coating has been applied and air dried to a green state. The sand pack suitably consists of silica sand such as Ottowa silica sand mixed with 2 to 30%, preferably 5 to 15% of elemental silicon powder, −325 mesh (U.S. Standard Sieve Series) and with 0.5 to 2%, preferably 1% of sodium chloride, all percents being by weight. Although silicon is preferred, it is also possible to employ alternatively other materials which act as gathering agents, such as Ti, TiH, iron-titanium alloy hydride, calcium hydride, calcium or magnesium silicide, aluminum, aluminum carbide, aluminum nitride, cobalt aluminide, iron aluminide, nickel aluminide and the like. The sand pack was found to effectively displace the bulk of the air from the tube ID (internal diameter) and the presence of silicon or other metal and sodium chloride conditioned the local atmosphere to provide an effective reducing environment. The sodium chloride acts as an activator of the metal, especially silicon, and aluminum, forming silicon and aluminum halide species by reaction with it. The metal halides are carried to all points in the pack mixture, consuming oxygen and moisture and providing some metallizing at the tube surface. The latter siliconizing and aluminizing effect is insufficient to affect the coating. However, if it should occur that there are areas where the green coating is damaged or does not achieve adequate coverage, the siliconizing and aluminizing which takes place is able to provide up to 150 microns of silicided and aluminided metal in these bare areas which, if covered, would have a mean coating thickness of about 300 to 400 microns. It is sufficient to fill the tube with the pack material and close the ends tightly, but not seal them, so as to permit the release of decomposition products of the binder material but not to allow inward diffusion of air from the furnace atmosphere, and heat treat the tube. This method of sand packing holds the green coating in place on the inner surface of the tube so that gas release does not lift the coating away from the surface and, in this manner, eliminates blistering. The surface condition of coatings fired in this way is of good quality. Moreover, the sand pack does not sinter when fired and is easily poured out of the tube on completion of the heat treatment or is removed by water lancing. Another pack includes one or more dimethyl polysiloxane or other silicone compounds in addition to NaCl. These compounds decompose to form volatile Si-containing species, and reducing gases such as hydrogen. In addition, they are hydrophobic and help to keep pack material dry and free-flowing. In a preferred pack, the constituents are 5 to 15% by weight of silicon powder, 1 to 10% aluminum powder or nickel aluminide, 0.5 to 2% NaCl, 1 to 5% by weight of tris(tri-butoxymethyl siloxy)silicone, balance silica sand. The silica sand should preferably be in the mesh range of −30 to +40 or between 400 and 600 microns diameter, and consist of rounded granules rather than the more common angular variety. Finer sand tends to produce capillarity which will remove the coating during the heat treatment. Fine sand also has insufficient gas permeability to allow the pack to work effectively and leads to stiffening of the pack during heat treatment which makes the pack difficult to remove.

The heat treatment for tubular samples coated with formulations as illustrated in the following examples suitably may involve a slow gradual rise in temperature from ambient to 650° F., followed by a rise to about 1650° to 1850° F. at a rate of 200° to 300° F. per hour where it is held for about 5 minutes to 1 hour depending on the outside diameter of the tube, the longer times being used for larger diameter tubes. Tubes ae then furnace cooled to between 1200° and 1650° F. in not less than 15 minutes after which they are cooled but not quenched to ambient temperature in not less than 10 minutes. Such a heat treatment provides an excellent quality coating. It will be understood that it is necessary to slightly modify the heat treatment time, rate of rise and holding times for different substrate alloys of different sizes and configurations. In general, a useful temperature range is about 1290° to 1850° F.

The invention is illustrated by the following examples which are not to be taken as limiting.

EXAMPLE 1

A coating composition was prepared by mixing an Al-12Si eutectic powder (about 6% by weight) made by gas atomization, with elemental silicon powder (about 40% by weight), both having about −350 mesh size. The constituents were both melted together with the vehicle, ethyl methacrylate in trichloroethane (available commercially under the tradename Nicrobraze 300 cement, Wall-Colmony Co., Detroit, Mich.).

The above coating composition was painted on a 316 stainless steel tube, 10" long and ¾" diameter using the fill and drain method. These applications provided a finished coating of about 80 microns after heat treatment in a silica, 5% Al, 5% Si, 5% Ni, 1% NaCl, 1% tris(tri-secbutoxysiloxy)methylsilane oil containing pack mix. Heat treatment of the pack protected paint was done in an air furnace starting from ambient temperatures. The temperature was raised to about 343° C. (650° F.) and held for one hour to permit the slow effusion of binder decomposition products from the paint. After the first hold, the temperature was again raised at about 200° to 300° F. per hour to about 1650°–1850° F. where it was again held for one hour. After the hold period, the material was cooled rapidly but consistent with the microstructural needs of the substrate material. At ambient temperature the pack material was poured out.

The coated tube was exposed in methane-hydrogen gas at 1200° F. under conditions which normally produce metal dusting and coke deposition on uncoated 316 stainless steel. The coated tube showed no metal dusting, absence of appreciable coke and no carbon pick up in the 316 matrix under the coating.

EXAMPLE 2

The same coating composition as prepared in Example 1 was applied to the inner diameter of 347 stainless steel return bends and extensions of a furnace by the spraying and fill and drain techniques. A pack consisting of silica blast sand, 5% Al, 5% Si, 5% 410 stainless powder and 1% sodium chloride was loaded into the painted and dried tubes, capped and heat treated to a peak temperature of 1650° F. with a two hour hold and then air quenched to ambient temperature.

The return bends previously suffering severe erosion in NMP extract furnace service, were found not to lose metal in the same operation after coating and reinstallation of the return bends.

EXAMPLE 3

The same coating composition as prepared in Example 1 was applied to the ID of a thick wall pressure tube of 304 stainless steel, 8' long and 6" OD. The paint was centrifuged onto the tube by rotating the tube in a lathe at 16 rpm and blowing heated air while still turning the tube so as to dry the coating. The tube was heat treated with a pack as in Example 1 and the resulting coating was then polished leaving a 90 micron thickness. The coated tube was then cleaned of polishing residue and prepared for welding into a visbreaker furnace.

To simulate the use of the coated tube in a visbreaker, a 304 stainless steel disc was coated and polished in the same manner as the tube described above and exposed in a hydrocarbon containing autoclave. No evidence of coke accumulation on the polished surface was observed.

What is claimed is:

1. A method of coating a metal substrate which comprises applying to said substrate a hypereutectic aluminumsilicon composition in the form of a slurry in a liquid vehicle comprising a mixture of (1) an Al-Si eutectic, Al-Si hypereutectic or elemental aluminum powder in combination with (2) elemental silicon powder, heating the coating composition to a temperature high enough to form eutectic liquid but low enough to retain elemental silicon in solid form, said heating taking place in the presence of an oxidation-protective pack which comprises silica sand mixed with about 2 to about 30% by weight silicon powder and about 0.05 to about 2% by weight NaCl, and then cooling to form the final coating which contains aluminides and silicides formed from the interaction with the metal substrate, said composition mixture components being present in sufficient amounts to provide the final coating with a net silicon content of about 20 to about 80% by weight.

2. The method of claim 1 in which the substrate is a ferrous metal or alloy, the coating is applied to the substrate as a slurry of said components in particle form in a fugitive organic liquid vehicle and the composition mixture comprises about 9 to about 77% by weight elemental silicon and about 91 to about 23% by weight of 88Al-12Si eutectic.

3. The method of claim 1 wherein the heating is to a temperature of about 1650° to about 1850° F.

4. The method of claim 1 wherein the substrate is selected from the group consisting of iron based alloys of types HK-40, HP, Manaurite 36XS, Manaurite 900B, Duraloy HOM, Incoloy Alloy 800, Incoloy Alloy 800H and stainless steels of types 304, 310, 316 and 347.

* * * * *